US007321745B2

(12) United States Patent
Kawano

(10) Patent No.: US 7,321,745 B2
(45) Date of Patent: Jan. 22, 2008

(54) DEVELOPER SUPPLY ROLLER AND DEVELOPING UNIT

(75) Inventor: Masahiro Kawano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 14 days.

(21) Appl. No.: 10/953,266

(22) Filed: Sep. 30, 2004

(65) Prior Publication Data

US 2005/0111886 A1 May 26, 2005

(30) Foreign Application Priority Data

Nov. 20, 2003 (JP) ..... 2003-390049

(51) Int. Cl.
*G03G 15/08* (2006.01)

(52) U.S. Cl. ..... 399/281; 399/283

(58) Field of Classification Search ..... 399/281, 399/283, 272, 273

See application file for complete search history.

(56) References Cited

U.S. PATENT DOCUMENTS 5,473,417 A * 12/1995 Hirano ..... 399/285
5,930,570 A * 7/1999 Saito et al. ..... 399/279
6,196,958 B1 * 3/2001 Shiraki et al. ..... 492/59

* cited by examiner

*Primary Examiner*—David M Gray
*Assistant Examiner*—Geoffrey T Evans
(74) *Attorney, Agent, or Firm*—Takeuchi & Kubotera, LLP

(57) ABSTRACT

A developer supply device provided is in contact with a developer carrying device. It comprises a surface member having at least one opening elongated in an axial direction of the developer supply device. The number of cellular walls counted in the circumferential direction is increased without increasing the number of openings so that the power of scraping the developer is increased. As a result, the dirty background on the print is minimized, thus enhancing the image quality.

12 Claims, 13 Drawing Sheets

DEVELOPER SUPPLY ROLLER AND DEVELOPING UNIT

BACKGROUND OF THE INVENTION

1. Field of the Invention

The present invention relates to developer supply rollers and developing units.

2. Description of the Related Art

Conventionally, an image forming apparatus, such as an electrophotographic printer, a copier, or a facsimile machine, includes an exposure unit for exposing a predetermined area of a photosensitive drum uniformly charged to form an electrostatic latent image, a developing unit for developing the electrostatic latent image to form a toner image, and a transfer/fixing unit for transferring the toner image to a recording medium, such as paper, and fixing it thereto.

The developer or toner is depleted or the photosensitive drum or each roller is worn down after repeated printings so that when the developer is depleted or the photosensitive drum or each roller is worn down, the developing unit or EP cartridge that includes a photosensitive drum and each roller and contains a toner is replaced.

FIG. 2 shows a conventional EP cartridge. A photosensitive drum 11 is rotatable and produces an electrostatic latent image on its surface. A developer carrying member or developing roller 12 is disposed so as to contact with the photosensitive drum 11 for supplying the photosensitive drum 11 with a toner 13. A toner layer forming blade 14 is disposed in contact with the developing roller 12 for forming a thin layer of toner 13 on the developing roller 12 to control the amount of toner 13 supplied to the photosensitive drum 11 by the developing roller 12.

A developer supply roller or toner supply roller 15 supplies the developing roller 12 with toner 13 and scraps the toner 13 that is not used for developing a toner image and remains on the developing roller 12. A cleaning blade 16 is disposed in contact with the photosensitive drum 11 to remove the toner 13 remaining on the photosensitive drum 11 after the toner image is transferred to a recording medium. The toner 13 is held by each of the photosensitive drum 11, the developing roller 12, and the toner supply roller 15 by a mirror image force.

A charging roller 17 is disposed in contact with the photosensitive drum 11 for uniformly charging the surface of the photosensitive drum 11 to establish a predetermined surface potential on the photosensitive drum 11. A light source 18 forms a latent image on the photosensitive drum 11.

The photosensitive drum 11, the developing roller 12, the toner layer forming blade 14, the toner supply roller 15, the cleaning blade 16, and the charging roller 17 constitute an EP cartridge in which the toner 13 is contained.

The toner supply roller 15, which not only supplies the toner 13 but also scraps the remaining toner 13 from the developing roller 12, has a foam rubber that has a large number of cellular holes in the surface.

FIG. 3 shows the surface of a conventional toner supply roller. A plurality of cellular holes 15*c* are formed in the surface of the toner supply roller 15 and a cellular wall 15*d* is formed between the respective cellular holes 15*c*.

When the toner supply roller 15 is rotated in contact with the developing roller 12 (FIG. 2), the toner 13 contained in the cellular holes 15*c* is supplied to the developing roller 12. The toner 13 remained on the developing roller 12 is scraped into the cellular holes 15*c* by the cellular wall 15*d*.

By increasing the number of cellular holes 15*c* in a unit area of the toner supply roller 15 or providing a spiral projection on the toner supply roller 15, it is possible to increase the power for scraping the remaining toner 13 from the developing roller 12. See JP 2000-56556 for example.

However, it is necessary to reduce the diameter of the cellular holes 15*c* in order to increase the number of cellular holes 15*c*. In addition, if the diameter of cellular holes 15*c* is too small, the amount of toner 13 in the cellular hole 15*c* becomes too small to supply the developing roller 12 with the satisfactory amount of toner 13.

The spiral projection formed on the toner supply roller 15 needs a special forming mold or the application of a heat ray to the toner supply roller 15, making the operation complicated and raising the manufacturing cost of the EP cartridge.

SUMMARY OF THE INVENTION

Accordingly, it is an object of the invention to provide a developer supply device and a developing unit capable of supplying a satisfactory amount of developer to a developer carrying device and minimizing the manufacturing cost of the developing unit.

According to the invention there is provided a developer supply device provided in contact with a developer carrying device, comprising a surface member having at least one opening elongated in an axial direction of the developer supply device.

The developer supply device comes into contact with the developer carrying device for supply of the developer. At least one opening has a substantially elliptic shape that contains a sufficient amount of developer to be supplied to the developer carrying device from the developer supply device, thus preventing faint printing and enhancing the image quality.

The number of cellular walls counted in the circumferential direction is increased without increasing the number of openings so that the power of scraping the developer is increased. Consequently, it is unnecessary to form a spiral projection on the developer supply device so that neither special metal mold nor heat ray process is required. As a result, the work is simplified and the manufacturing cost of the developing unit is lowered.

DESCRIPTION OF THE PREFERRED EMBODIMENTS

Embodiments of the invention will now be described with reference to the accompanying drawings. An electrophotographic printer is taken as an example of the image forming apparatus.

Figure 4:
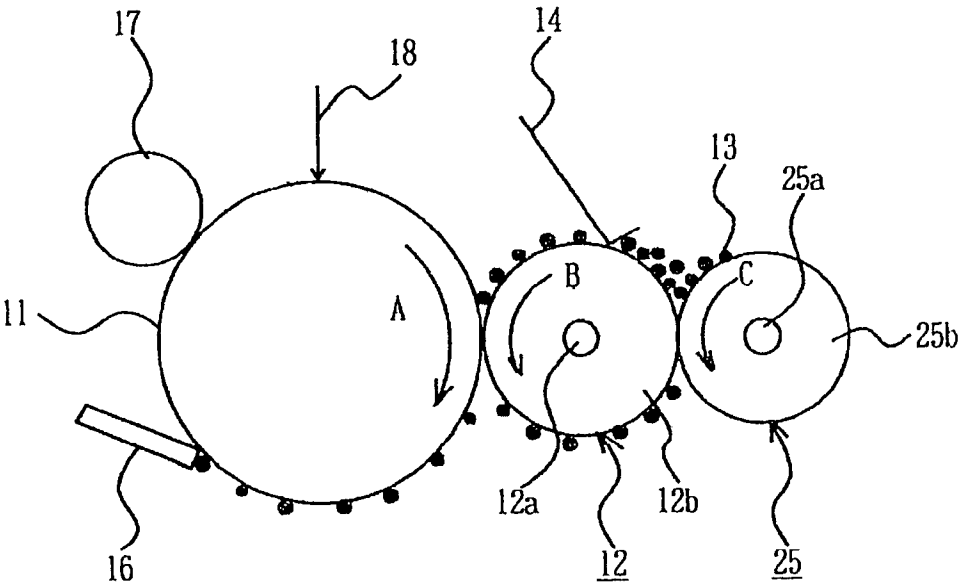
FIG. 4 is a side view of an EP cartridge according to the first embodiment.

In FIG. 4, an image carrying member or photosensitive drum 11 is rotatable in the direction of an arrow A and carries a latent image on the surface. A developer carrying member or developing roller 12 is rotatable in the direction of an arrow B in contact with the photosensitive drum 11 for supplying the photosensitive drum 11 with a developer or toner 13. A toner layer forming blade 14 is disposed in contact with the developing roller 12 for forming a thin layer of toner 13 on the developing roller 12 to control the amount of toner 13 supplied to the photosensitive drum 11 from the developing roller 12. The developing roller 12 is made up of a metal shaft 12*a* and a cylindrical tube 12*b* of semiconductive urethane rubber coated on the metal shaft 12*a*. The toner 13 used is a non-magnetic, one-component toner negatively charged.

A developer or toner supply roller 25 is rotatable in the direction of an arrow C in abutment with the developing roller 12 for supplying the developing roller 12 with the toner 13 and scraping the toner that is not used for developing a toner image and remains on the developing roller 12. A cleaning device or blade 16 is disposed in contact with the photosensitive drum 11 to remove the toner 13 remaining on the photosensitive drum 11 after the toner image is transferred to a record medium or paper. The toner 13 is held on each of the photosensitive drum 11, the developing roller 12, and the toner supply roller 25 by a mirror image force. The developing roller 12, the toner layer forming blade 14, and the toner supply roller 25 constitute a developing unit.

A charging roller 17 is disposed in contact with the photosensitive drum 11 for uniformly charging the surface of the photosensitive drum 11 to establish a predetermined surface potential on the photosensitive drum 11. An exposure device or light source 18 forms a latent image in the surface of the photosensitive drum 11. An LED head or laser generator is used for the light source 18.

The photosensitive drum 11, the developing roller 12, the toner layer forming blade 14, the toner supply roller 25, the cleaning blade 16, and the charging roller 17 constitute a developing unit or EP cartridge, in which the toner 13 is contained.

The toner supply roller 25 is made by covering a metal shaft 25*a* with a tube of foam rubber or urethane rubber 25*b* having a large number of cellular holes in the surface. The tube of urethane rubber 25*b* is bonded to the shaft 25*a* while being pulled in the axial direction.

Figure 1:
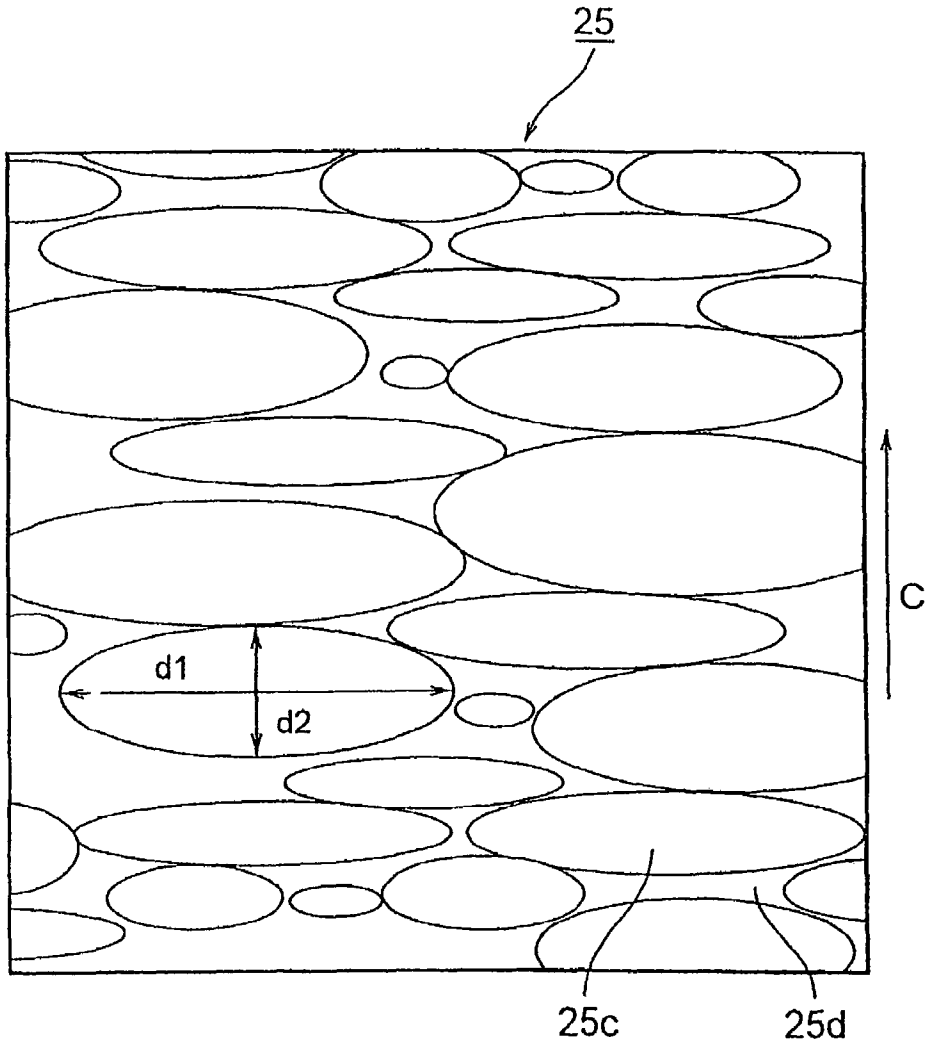
FIG. 1 is a diagram showing the surface of a toner supply roller according to the first embodiment of the invention.
Figure 2:
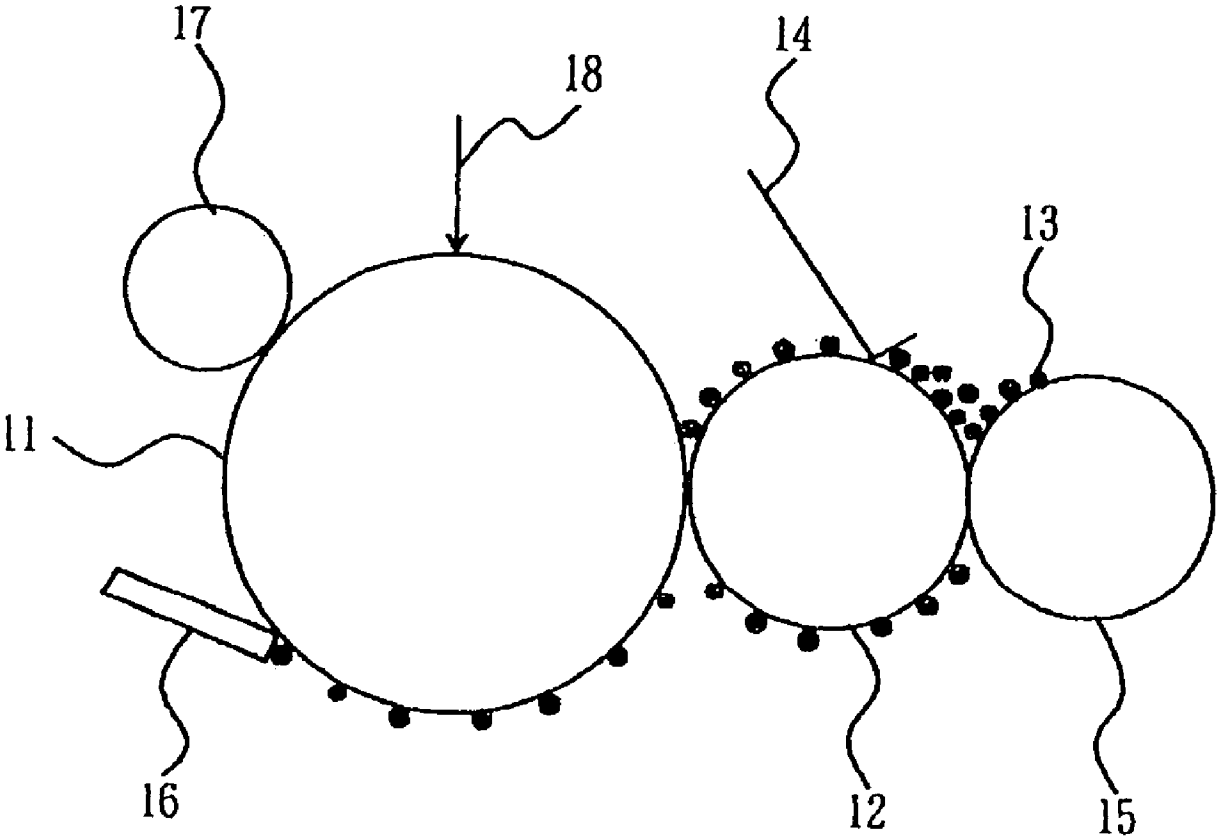
Prior Art FIG. 2
FIG. 2 is a side view of a conventional EP cartridge.

FIG. 1 shows a square of the surface of the toner supply roller 25, the opposed sides of which are parallel to the direction C in which the toner supply roller 25 is rotated. A plurality of elliptical openings or cellular holes 25*c* are formed in the surface of the toner supply roller 25 and a cellular wall 25*d* is formed between the respective cellular holes 25*c*. d1 is the diameter (major axis) of a cellular hole 25*c* in the axial direction of the toner supply roller 25 and d2 is the diameter (minor axis) of a cellular hole 25*c* in the rotational and operational direction of the toner supply roller 25.

The urethane rubber 25*b* is bonded to the shaft 25*a* while being pulled in the axial direction (FIG. 4) so that the respective cellular holes 25*c* are stretched in the axial direction of the toner supply roller 25 and that the diameter d1 becomes greater than d2 for each cellular hole 25*c*, providing the elliptical shape. The respective cellular holes 25*c* hold the stretched shape after being bonded. Consequently, the respective cellular holes 25*c* are arranged such that their major axes are aligned with the axis of the toner supply roller 25.

The average values or diameters d1 and d2 are 300 and 100 um, respectively, for the toner supply roller 25 used in this embodiment.

The urethane rubber 25*b* may be replaced by another rubber material such as silicon rubber, EPDM, acrylic rubber. If d1 becomes greater than d2, any of other materials may be used for the toner supply roller 25.

In the above EP cartridge, the developing roller 12 and the toner supply roller 25 are rotated in the same direction so that when they are brought into contact, the toner 13 remained on the developing roller 12 is scraped by the cellular wall 25*d* of the toner supply roller 25. However, when the developing roller 12 or the toner supply roller 25 is contracted under different environment or worn down with the passage of time, the developing roller 12 and the toner supply roller 25 can fail to contact with each other. Consequently, the toner supply roller 25 is pushed into the developing roller 12 by 0.3-1.5 mm from the non-pressure contact surface. When the amount of push exceeds 1.5 mm, neither power of scraping the toner 13 by the toner roller 25 nor power of supplying the toner 13 to the developing roller 12 is enhanced. The torque for rotating the toner supply roller 25 becomes so high that the resulting print has a horizontal trace called "jitter." The amount of push for the toner supply roller 25 in this embodiment is 1 mm.

A voltage is applied to each of the developing roller 12 and the toner supply roller 25 so that the toner 13 is transported from the toner supply roller 25 to the developing roller 12 according to the direction of an electric field. Specifically, a d-c voltage of −450 V is applied to the toner supply roller 25 while a d-c voltage of −300 V is applied to the developing roller 12.

A surface potential of −800 V is established by a charging device (not shown) on the photosensitive drum 11. When the surface of the photosensitive drum 11 is exposed to the light source 18, the surface potential of an image area becomes −50 V, forming an electrostatic latent image. In this way, the direction of an electric field is changed so that the toner 13 is supplied to the photosensitive drum 11 from the developing roller 12, making the latent image visible to form a toner image.

The operation of a cellular hole 25*c* formed in the toner supply roller 25 will be described with reference to FIGS. 5-8.

Figure 5:
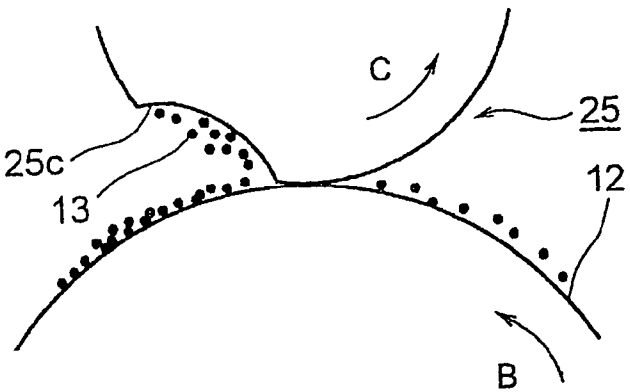
FIG. 5 is the first diagram showing the operation of a cell hole according to the first embodiment.
Figure 6:
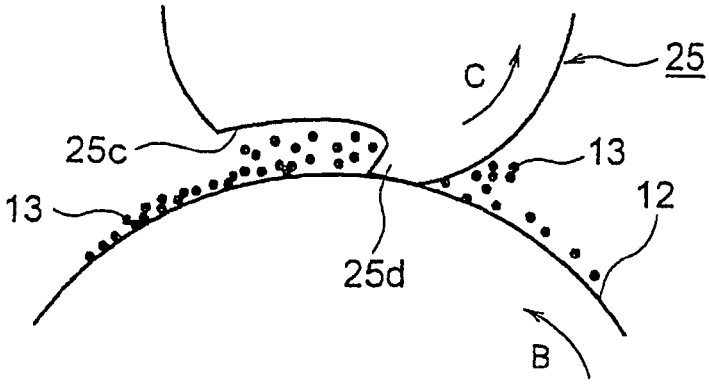
FIG. 6 is the second diagram showing the operation of the cell hole according to the first embodiment.
Figure 7:
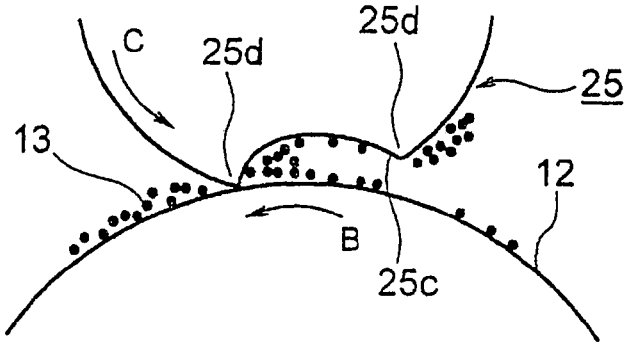
FIG. 7 is the third diagram showing the operation of the cell hole according to the first embodiment.

In FIG. 5, the cellular hole 25*c* is prior to contact with the developing roller 12. In FIG. 6, the cellular wall 25*d* is scraping the toner 13 on the developing roller 12 in the direction of rotation of the toner supply roller 25 while the toner 13 is supplied to the developing roller 12 from the cellular hole 25*c*. In FIG. 7, the supply of the toner 13 from the cellular hole 25*c* is completed and the rear cellular wall 25*d* is scraping the toner 13 on the developing roller 12.

Figure 8:
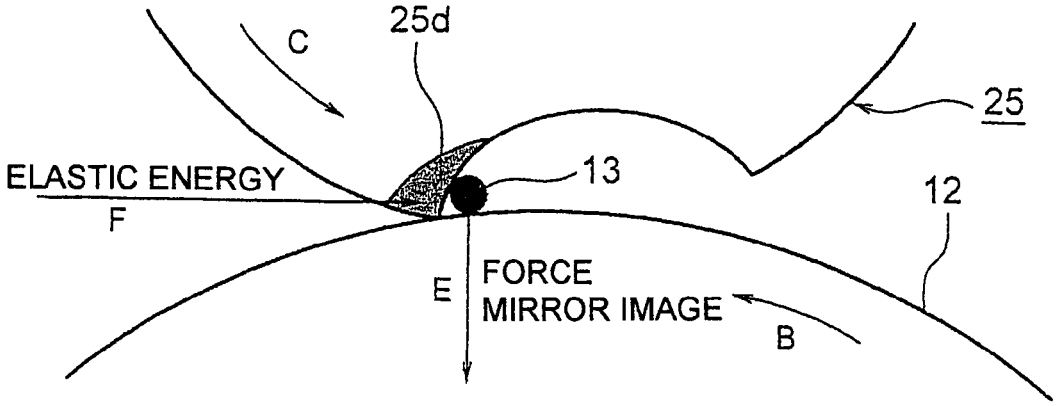
FIG. 8 is the fourth diagram showing the operation of the cell hole according to the first embodiment.

The toner 13 is charged by friction and contact and held on the developing roller 12 by a mirror image force acting in the direction of an arrow E as shown in FIG. 8. When the toner supply roller 25 contacts with the developing roller 12 as shown in FIG. 5, the surface of the tone supply roller 25 is deformed as shown in FIG. 6. When the cellular wall 25*d* comes in contact with the toner 13 on the toner supply roller 25 as shown in FIG. 7, it is flexed to store an elastic energy in the direction of an arrow F as shown in FIG. 8.

The cellular hole 25*c* is a recess and does not act on the toner 13 on the developing roller 12 but the cellular wall 25*d* forms a projection and exerts a scraping action on the toner 13 with the stored elastic energy. That is, the cellular wall 25*d* scrapes the toner 13 that is not used for development and remains on the developing roller 12 and the elastic energy is used for the scraping.

In order to raise the power of scraping the remaining toner 13, the number of cellular holes 25*c* should be increased so that the number of cellular walls 25*d* acting for a unit time becomes large. Thus, the diameter d2 of cellular hole 25*c* (FIG. 1) is reduced to increase the number of cellular holes 25*c* per unit area of the toner supply roller 25, thereby maximizing the number of cellular walls 25*d* acting on the toner 13.

The toner supply roller 25 comes into contact with the developing roller 12 during rotation so that only the cellular walls 25*d* extending in the axial direction contribute the scraping of the toner 13 and no cellular walls 25*d* extending in the rotational direction make any contribution to the tone scraping. Thus, only the cellular walls 25*d* extending in the axial direction are essential.

For this reason, according to the embodiment, the diameter d1 of a cellular hole 25*c* is made greater than d2.

Figure 9:
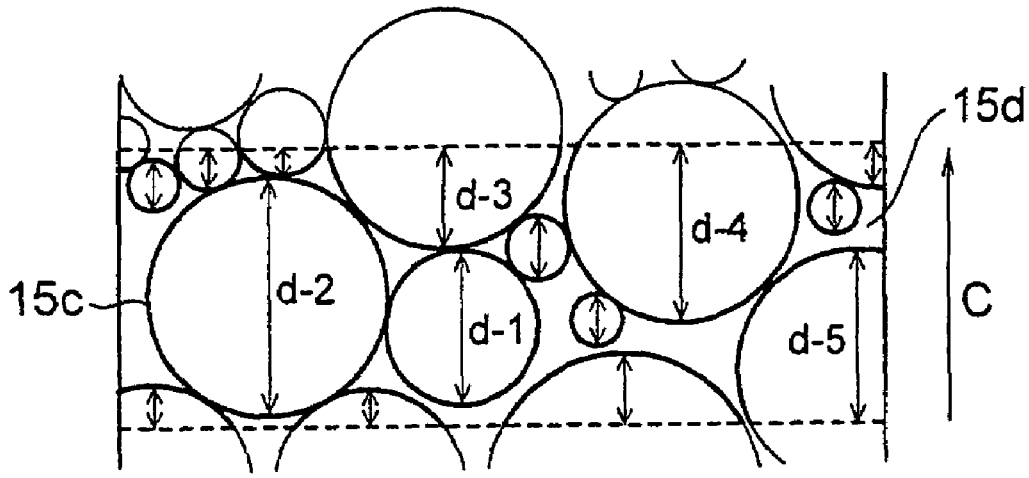
Prior Art FIG. 9
FIG. 9 is a diagram showing a conventional cell hole.
Figure 10:
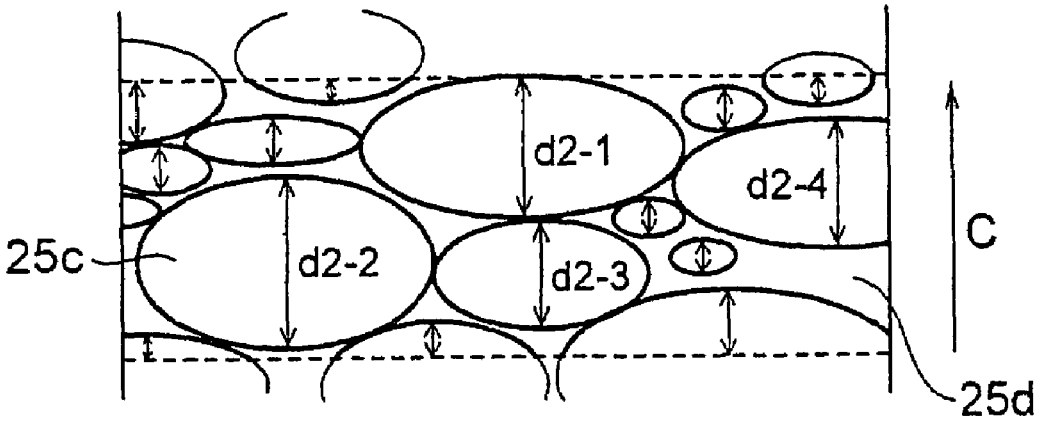
FIG. 10 is a diagram showing the condition of a cell hole according to, the first embodiment.

A comparative result of the cellular holes 15*c* between the conventional toner supply roller 15 and the toner supply roller 25 will be described with reference to FIGS. 9 and 10.

When the circumference of the circular cellular hole 15*c* is equal to that of the elliptic cellular hole 25*c*, the number of cellular walls 25*d* for a unit length in the circumferential direction of the toner supply roller 25 is greater than that of the cellular walls 15*d* so that the density of cellular walls 25*d* per unit area making a contribution to the toner scraping is high.

In order to increase the number of cellular walls 15*d* making a contribution to the tone scraping in the conventional circular cellular holes 15*c*, it is necessary to reduce the diameters of the cellular holes 15*c*. The toner 13 adheres to the insides of cellular holes 15*c* during the use of the developing roller 12 and the toner supply roller 15, reducing the volume of the cellular holes 15*c* and the amount of toner 13 contained in the cellular holes 15*c*. Consequently, the amount of toner 13 supplied to the developing roller 12 from the toner supply roller 15 becomes so small that the print becomes faint and patchy, lowering the image quality.

The relationship between the average diameter d-av of diameters d-i (i=1, 2, . . . ) of cellular holes 15*c* in a predetermined area in the rotational direction and the average diameter d2-av of diameters d2-j (j=1, 2, . . . ) of cellular holes 25*c* is given by d-av>d2-av.

The urethane rubber 25*b* is bonded to the shaft 25*a* while being stretched in the axial direction so that the respective cellular holes 25*c* are stretched in the axial direction of the toner supply roller 25 so that the diameter d1 becomes greater than d2 for each cellular hole 25*c*, providing an elliptic shape. This assures that the amount of toner 13 contained in the cellular holes 25*c* is sufficient to eliminate the faint printing, thus enhancing the image quality.

The number of cellular walls 25*d* in the circumferential direction is increased without increasing the number of cellular holes 25*c* so that the power of scraping the toner 13 is enhanced. No spiral projection is formed on the toner supply roller 25 so that neither special mold nor heat ray process is necessary. Thus, the work is simplified and the manufacturing cost of an EP cartridge is reduced.

The following table 1 shows the paper stains when 10000 sheets are printed continuously by this printer under low temperature (10 degrees C.), low humidity (20%) circumstances.

TABLE 1

| Prints | Environment | 150 μm | 100 μm | 300 μm |
|---|---|---|---|---|
| 0 | 10° C., 20% | ○ | ○ | ○ |
| 1000 | 10° C., 20% | ○ | ○ | ○ |
| 2000 | 10° C., 20% | ○ | ○ | ○ |
| 3000 | 10° C., 20% | ○ | ○ | ○ |
| 4000 | 10° C., 20% | ○ | ○ | ○ |
| 5000 | 10° C., 20% | ○ | ○ | ○ |
| 6000 | 10° C., 20% | ○ | ○ | X |
| 7000 | 10° C., 20% | ○ | ○ | X |
| 8000 | 10° C., 20% | ○ | ○ | X |
| 9000 | 10° C., 20% | ○ | ○ | X |
| 10000 | 10° C., 20% | ○ | ○ | X |

150 μm is in d2-av and 100 μm and 300 μm are in d-av.

After 10000-sheet continuous printing, the printer was left under high-temperature (27° C.), high-humidity (80%) environment. When the charge of the toner 13 is lowered, printing was made with a print density of 100% to evaluate stains on paper. The results are shown in Table 2 below.

TABLE 2

| Prints | Environment | 150 μm | 100 μm | 300 μm |
|---|---|---|---|---|
| 10000 | 27 C., 80% | ○ | X | ○ |

150 μm is in d2-av of elliptic cellular holes 25c made by stretching the urethane rubber 25b in the axial direction having cellular holes of d-av of 300 μm, and 100 μm and 300 μm are in d-av of those of the toner supply roller 15.

As Table 1 shows, the toner supply roller 15 with cellular holes having d-av of 300 μm had poor scraping power under the low-temperature, low-humidity environment and failed to scrape the highly charged toner 13 from the developing roller 12, producing stains on the paper.

As Table 2 shows, the toner supply roller 15 with cellular holes having d-av of 100 μm, when the printer was left in the high-temperature, high-humidity environment after 10000-sheet continuous printing, provided poor supply of the toner 13, producing faint printing.

By contrast, the toner supply roller 25 with cellular holes having d2-av of 150 μm produced no stain after 10000 prints and no faint printing after the printer was left in the high-temperature, high-humidity environment.

Figure 11:
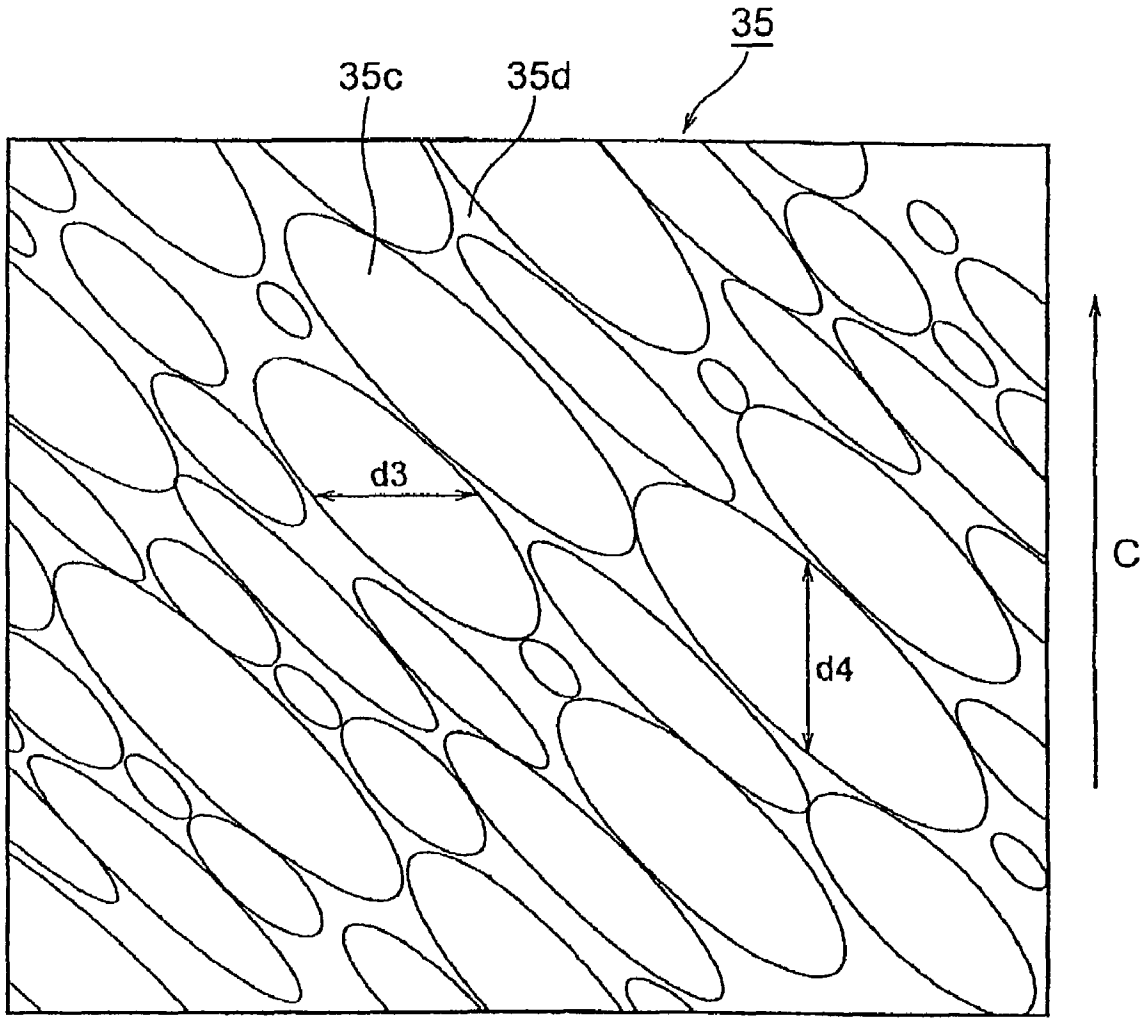
FIG. 11 is a diagram showing the surface of a toner supply roller according to the second embodiment of the invention.
Figure 12:
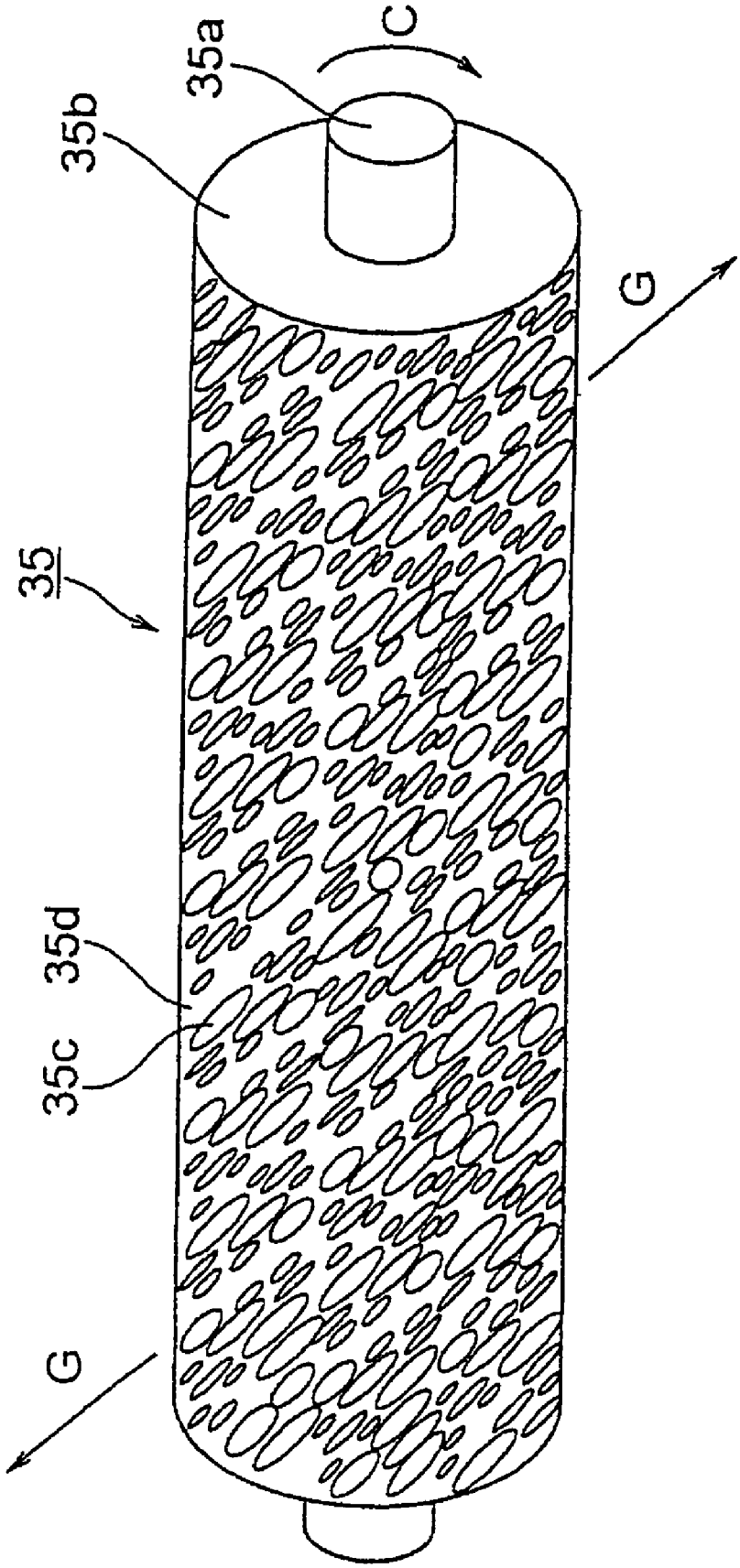
FIG. 12 is a perspective view of the toner supply roller according to the second embodiment.

The second embodiment of the invention by which the urethane rubber tube 25*b* is bonded to the shaft 25 while it is stretched in the axial direction and twisted in the rotational direction, will be described with reference to FIGS. 11 and 12. The same components as in the first embodiment are given the same reference numbers and their description will be omitted.

The developer or toner supply roller 35 is formed by bonding a urethane rubber tube 35*b* to a shaft 35*a* while it is stretched in the axial direction and tiled in the rotational direction so that it is twisted as shown by an arrow G. As a result, the openings or cellular holes 35*c* and cellular walls 35*d* are tilted with respect to the axial and rotational axes and formed in elliptic shapes arranged in parallel to each other. In other words, the major axis of each cellular hole 35*c* is tilted within a predetermined range of angles with respect to the axis of the toner supply roller 35. d3 is the diameter (major axis) of a cellular hole 35*c* in the axial direction of the toner supply roller 35 and d4 is the diameter (minor axis) of a cellular hole 35*c* in the rotational and operational direction of the toner supply roller 35.

In this way, the urethane rubber tube 35*b* is formed at an angle to the axial and rotational directions so that the diameter d3 of each cellular hole 35*c* is sufficiently large to assure a satisfactory amount of developer or toner 13 (FIG. 4) stored in the cellular hole 35*c*. Consequently, the amount of toner 13 supplied to the developing roller 12 from the toner supply roller 35 is sufficiently large to prevent faint printing, thus enhancing the image quality.

The number of cellular walls 35*d* counted in the circumferential direction is large without increasing the number of cellular holes 35*c* so that the power of scraping the toner 13 is high. No spiral projection is formed on the toner supply roller 35 so that neither special metal mold nor heat ray process is required, simplifying the work and reducing the manufacturing cost of the developing unit or EP cartridge.

The operation of the toner supply roller 35 and the printer will be described.

Figure 3:
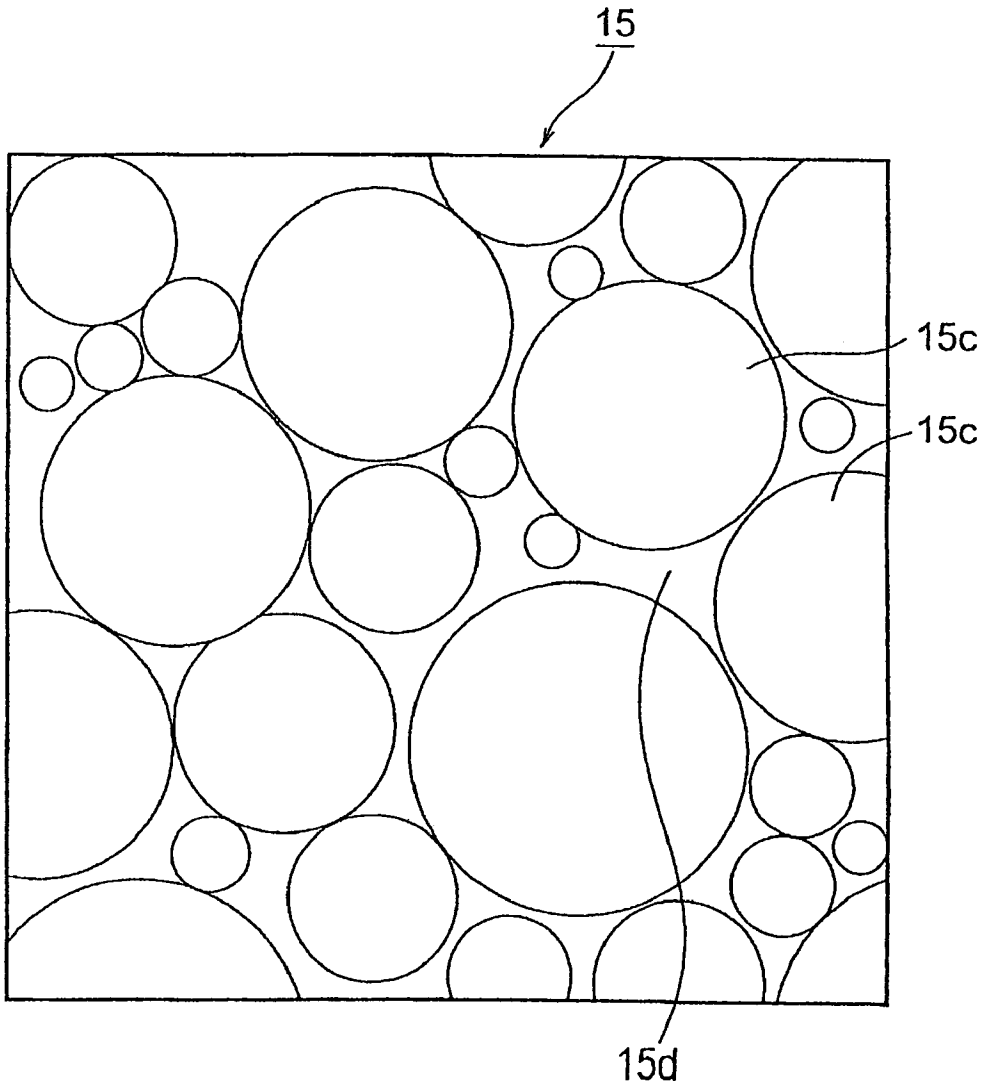
FIG. 3 Prior Art
FIG. 3 is a diagram showing the surface of a conventional toner supply roller.

First of all, the action of the toner 13 scraped by the front cellular walls 15*d* (FIG. 3) and 35*d* of the conventional toner supply roller 15 and the toner supply roller 35 according to the invention will be described with reference to FIGS. 13-16.

Figure 13:
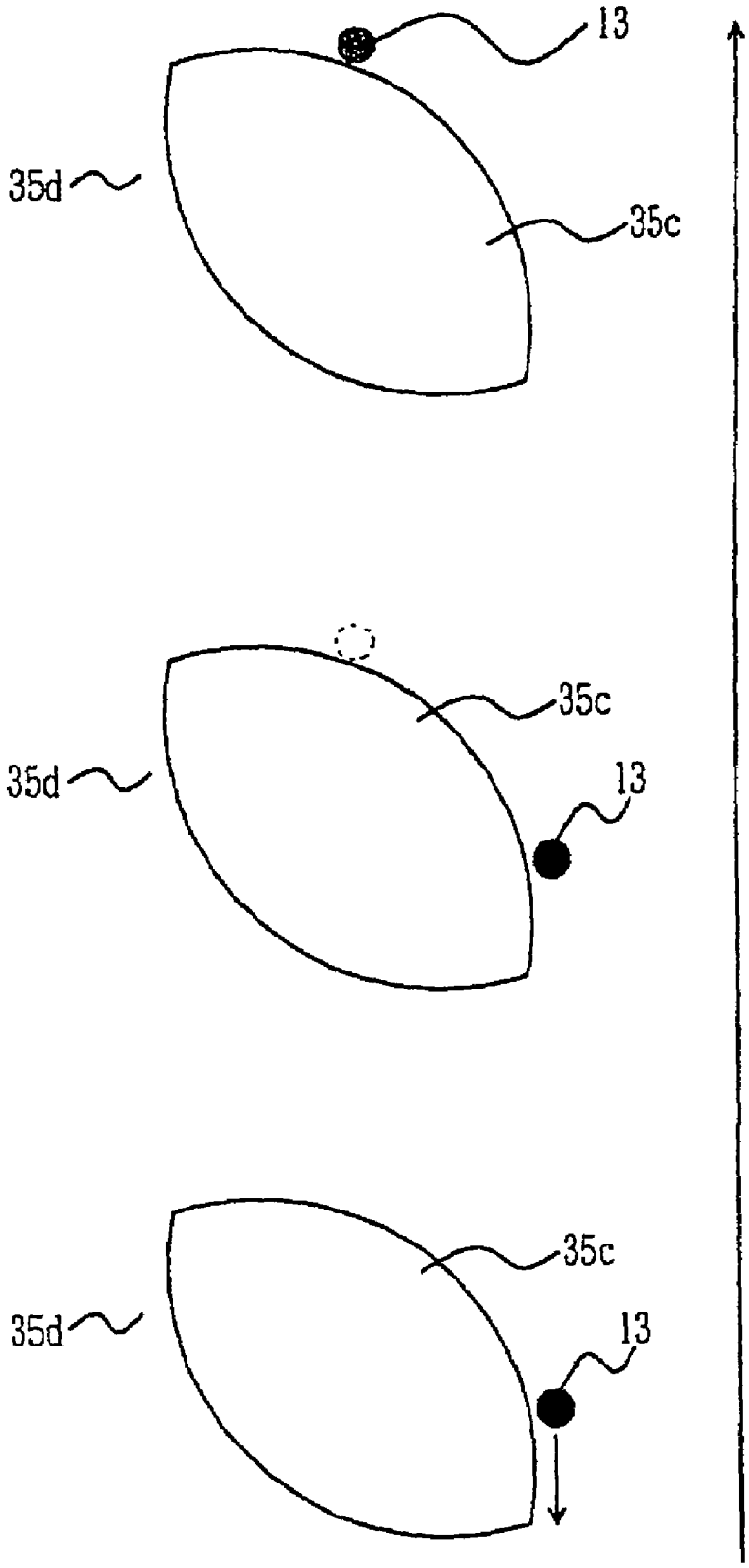
FIG. 13 is the first diagram that shows the action of a toner according to the second embodiment.
Figure 14:
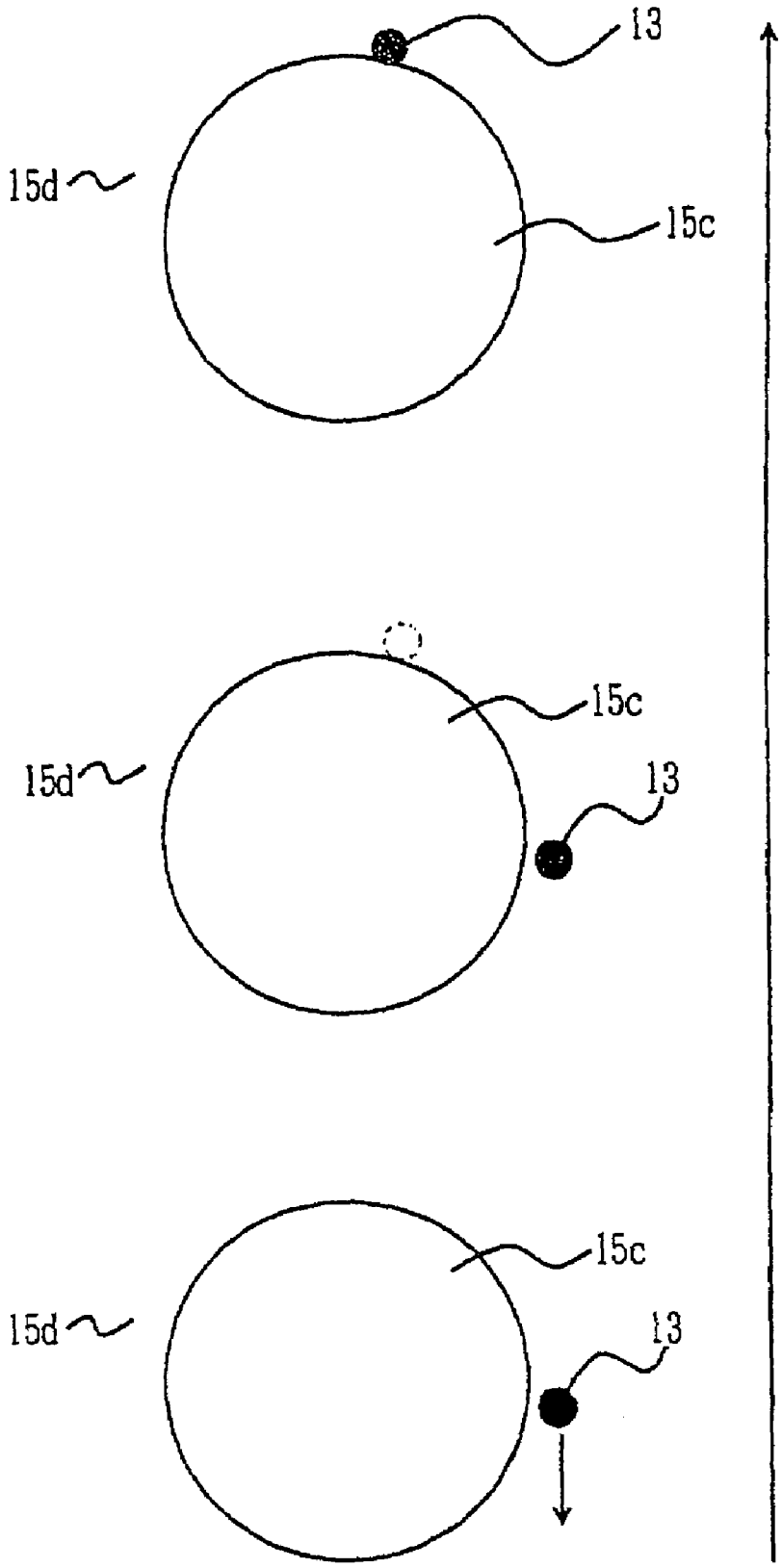
FIG. 14 Prior Art
FIG. 14 is the first diagram that shows the action of a conventional toner.

When the toner supply roller 35 (FIG. 12) or 15 is attached to the EP cartridge (FIG. 4) and rotated in the direction of arrow C, the toner 13 is scraped by the front cellular wall 35*d* or 15*d* to move along the cellular wall 35*d* or 15*d* without falling in the cellular hole 35*c* or 15*c* as shown in FIG. 13 or 14.

Figure 15:
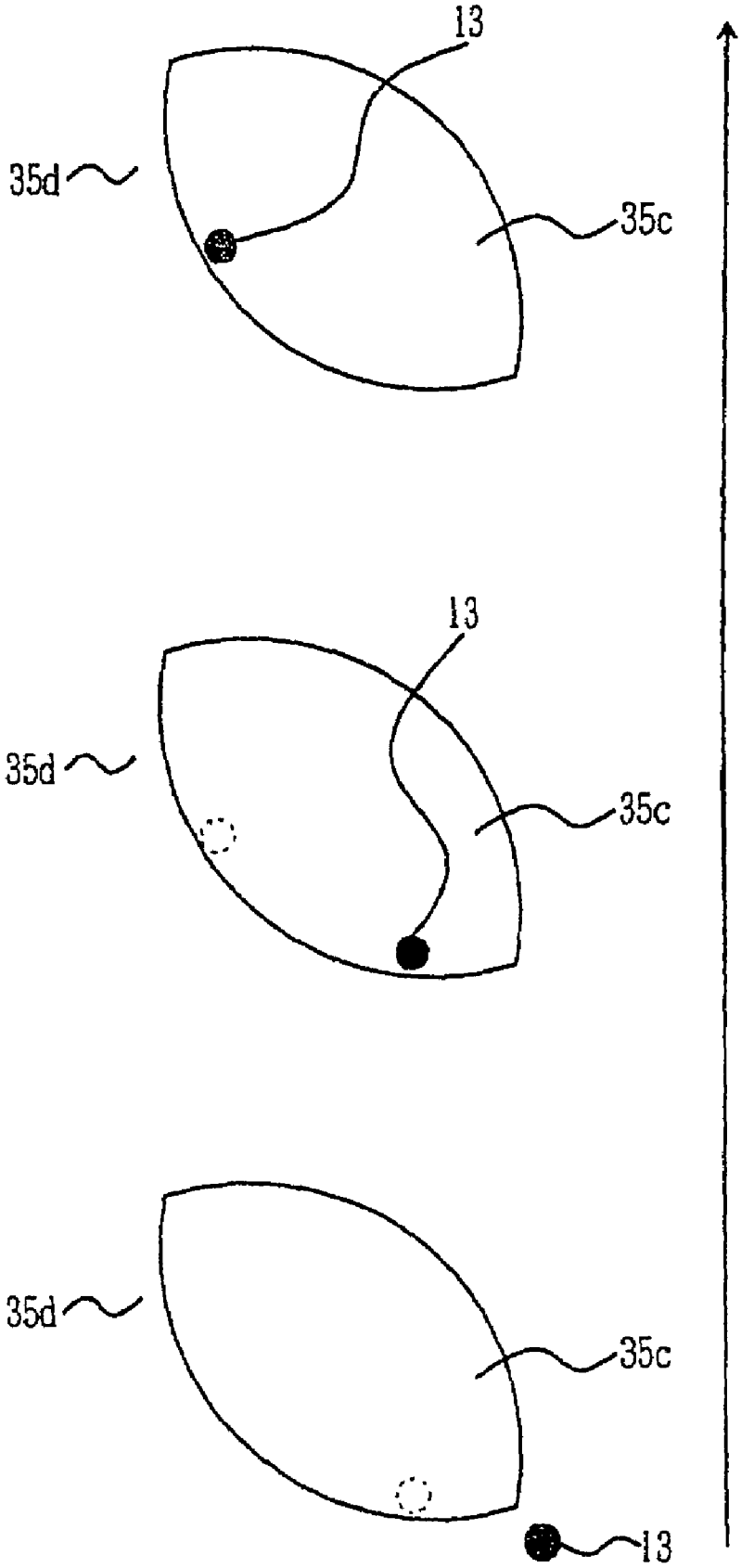
FIG. 15 is the second diagram that shows the action of the toner according to the second embodiment.
Figure 16:
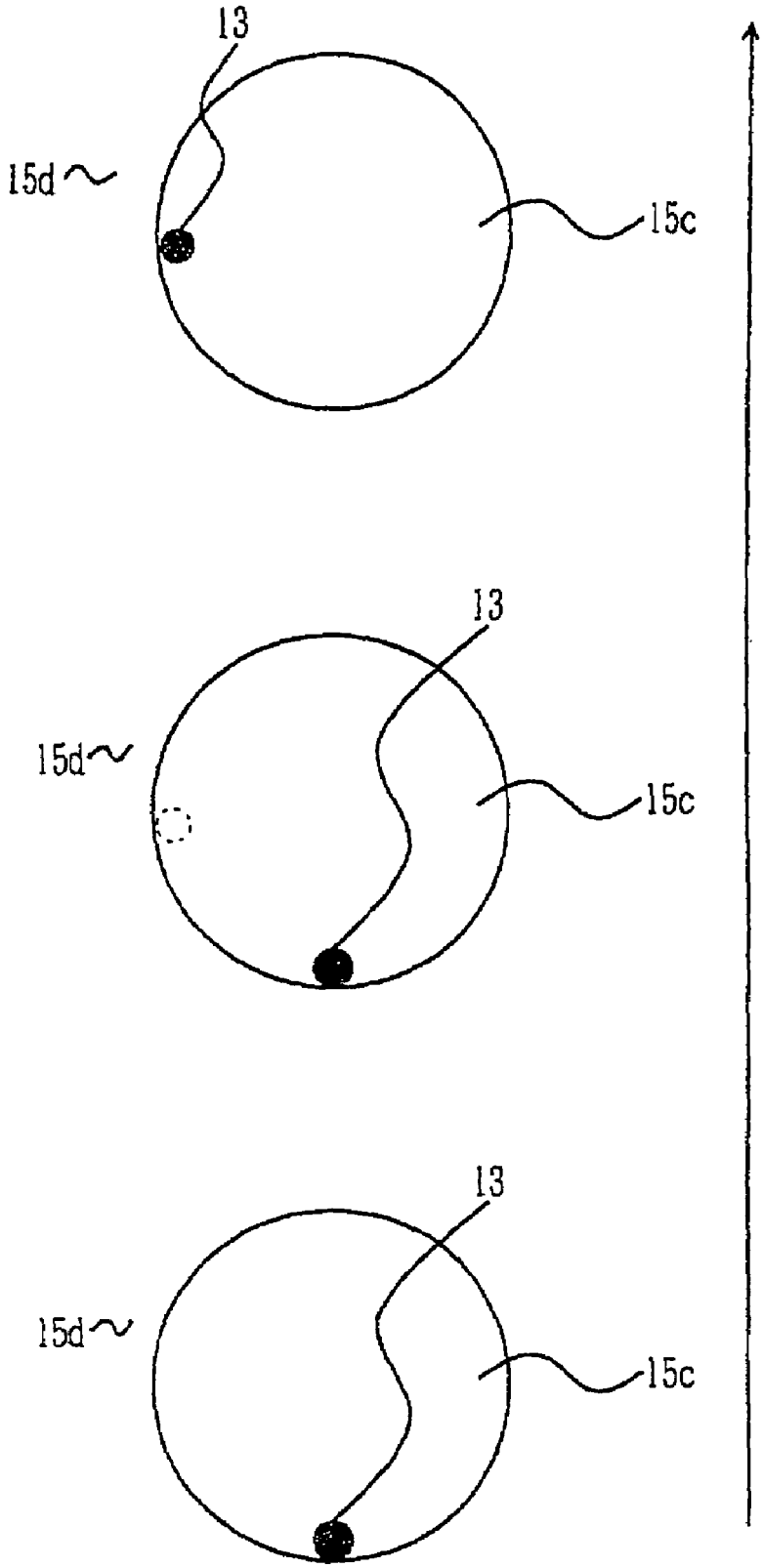
FIG. 16 Prior Art
FIG. 16 is the second diagram that shows the action of the conventional toner.

On the other hand, the toner 13 contained in the cellular hole 35*c* by the toner supply roller 35 moves along the cellular wall 35*d* as it rotates as shown in FIG. 15. The cellular hole 35*c* is tilted with respect to the axial direction of the toner supply roller 35 so that the moving speed of the toner 13 is so high that the toner 13 is discharged from the rear end of the cellular hole 35*c* by inertia. By contrast, the toner 13 contained in the cellular hole 15*c* by the toner supply roller 15 moves along the cellular wall 15*d* but the moving speed of the toner 13 becomes so low because of the non-slant form that the toner 13 is not discharged from the rear end but stays in the cellular hole 15*c* as shown in FIG. 16. As a result, the toner 13 accumulates in the cellular hole 15*c* of the toner supply roller 15 whereas no toner 13 accumulates in the cellular hole 35*c* of the toner supply roller 35.

Table 3 shows the results of 10000-sheet continuous printing test in the low temperature (10° C.), low humidity (20%) environment.

TABLE 3

| Prints | Environment | 150 μm | 100 μm | 300 μm |
|---|---|---|---|---|
| 0 | 10° C., 20% | ○ | ○ | ○ |
| 1000 | 10° C., 20% | ○ | ○ | ○ |
| 2000 | 10° C., 20% | ○ | ○ | ○ |
| 3000 | 10° C., 20% | ○ | ○ | ○ |
| 4000 | 10° C., 20% | ○ | ○ | ○ |
| 5000 | 10° C., 20% | ○ | ○ | ○ |
| 6000 | 10° C., 20% | ○ | ○ | X |
| 7000 | 10° C., 20% | ○ | ○ | X |
| 8000 | 10° C., 20% | ○ | ○ | X |
| 9000 | 10° C., 20% | ○ | ○ | X |
| 10000 | 10° C., 20% | ○ | ○ | X |

After the printer was left in the high temperature (27° C.), high humidity (80%) environment so that the charge of the toner 13 becomes low, printing was made with a print density of 100%. The results are shown in Table 4 below.

TABLE 4

| Prints | Environment | 150 μm | 100 μm | 300 μm |
|---|---|---|---|---|
| 10000 | 27 C., 80% | ○ | X | ○ |

100 μm and 300 μm are in d-av of the circular cellular holes 15c in the toner supply roller 15 and 150 μm is in d4-av of the elliptic cellular hole 35 made by stretching at an angle to the axial direction the urethane rubber tube 25b with cellular holes having d-av of 300 μm.

As Table 3 shows, the printer with the toner supply roller 15 with cellular holes having d-av of 300 μm produced stains on paper at $6000^{th}$ sheet due to failure to scrape the highly charged toner 13 from the developing roller 12 in the low-temperature, high-humidity environment.

As Table 4 shows, the printer with the toner supply roller 15 with cellular holes having d-av of 100 μm produced faint prints due to poor supply of the toner 13 when it was left in the high-temperature, thigh-humidity environment after 10000-sheet continuous printing.

By contrast, the printer with the toner supply roller 35 with cellular holes having d4-av of 150 μm produced neither stain on paper in the 10000-sheet continuous printing nor faint prints when it was left in the high-temperature, high-humidity environment after the 10000-sheet printing.

The present invention is not limited to the above illustrated embodiment and a variety of modifications may be made according the sprit of the invention but fall within the protective scope of the invention.

Figure 17:
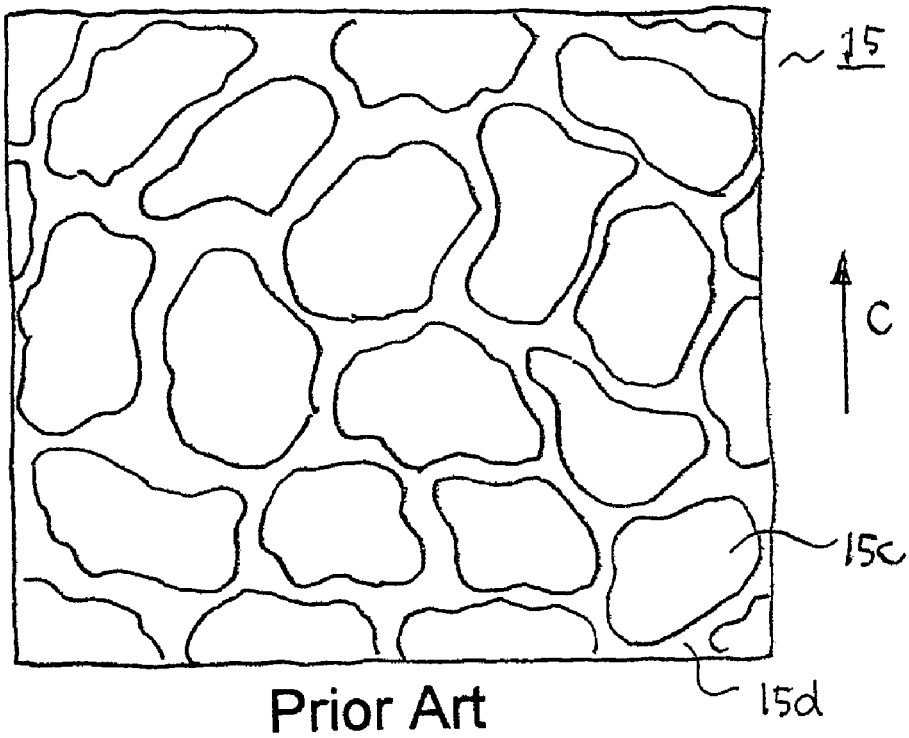
Prior Art FIG. 17
FIG. 17 is a diagram showing the actual surface of a conventional foam roller.
Figure 18:
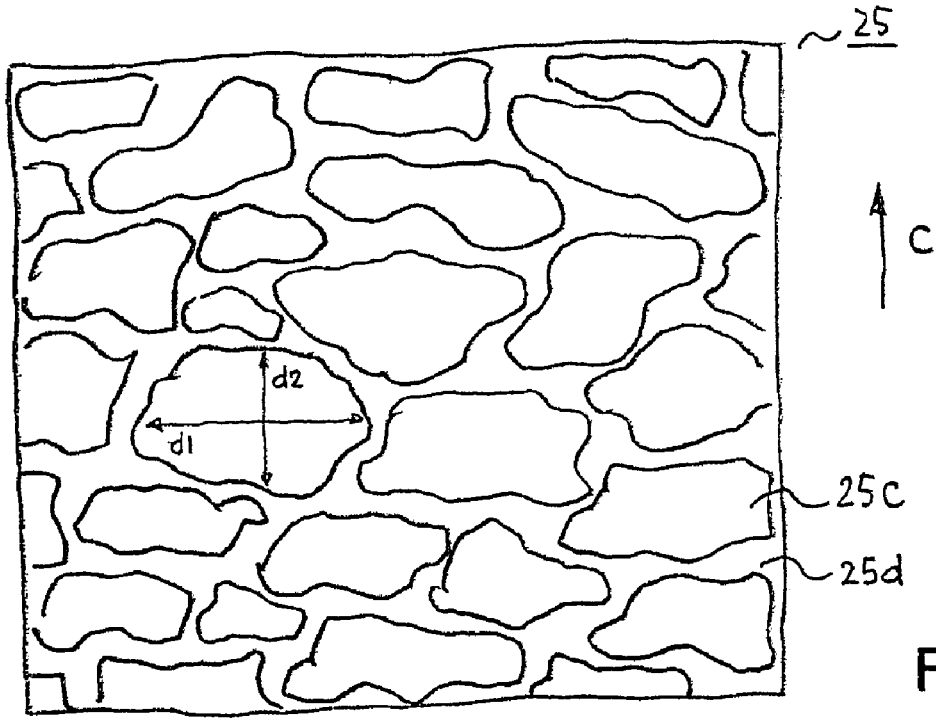
FIG. 18 is a diagram showing the actual surface of a foam roller corresponding to that of FIG. 1.

FIGS. 17 and 18 shows the cellular holes 15*c* and 25*c*, respectively, in more realistic way than in FIG. 1 wherein the forms of cellular holes are simplified.

The invention claimed is:

1. A developer supply device to be provided in contact with a developer carrying device, comprising:

a surface member having at least one opening elongated in an axial direction of the developer supply device; and a shaft to which said surface member is bonded while it is stretched in said axial direction.

2. The developer supply device according to claim 1, wherein said surface member is made of a foam rubber such that said opening is a foam opening.

3. The developer supply device according to claim 1, wherein said opening is constructed to transport a developer to said developer carrying device.

4. The developer supply device according to claim 1, wherein said opening is constructed to scrape a developer from said developer carrying device.

5. The developer supply device according to claim 1, wherein said developer supply device is a developer supply roller.

6. The developer supply device according to claim 5, wherein said developer supply roller rotates in a direction same as that of the developer carrying device.

7. A developing unit equipped with the developer supply device according to claim 1.

8. An image forming apparatus equipped with the developing unit according to claim 7.

9. A developer supply device to be provided in contact with a developer carrying device, comprising a surface member having a plurality of discrete substantially elliptical openings formed in a surface thereof contacting with the developer carrying device, said surface member being made of a foam rubber such that the discrete substantially elliptical openings are foam openings, substantially all of said discrete substantially elliptical openings extending in a first direction tilted with respect to the axial direction and tilted with respect to a second direction perpendicular to the axial direction.

10. The developer supply device according to claim 9, which further comprises a shaft to which said surface member is bonded while it is being stretched in said axial direction and twisted in a rotational direction of said developer supply device.

11. A developing unit equipped with the developer supply device according to claim 9.

12. An image forming apparatus equipped with the developing unit according to claim 11.

* * * * *